US006931666B1

(12) United States Patent
Brady

(10) Patent No.: US 6,931,666 B1
(45) Date of Patent: Aug. 23, 2005

(54) SERVING MITT

(76) Inventor: Clifford S. Brady, 4025 W. 242nd St., E2, Torrance, CA (US) 90505

( * ) Notice: Subject to any disclaimer, the term of this patent is extended or adjusted under 35 U.S.C. 154(b) by 8 days.

(21) Appl. No.: 10/299,322

(22) Filed: Nov. 18, 2002

(51) Int. Cl.[7] ..... A41D 19/00
(52) U.S. Cl. ..... 2/161.6; 2/16
(58) Field of Search ..... 2/16, 20, 59, 161.6

(56) References Cited

U.S. PATENT DOCUMENTS 2,082,574 A * 6/1937 Handley ..... 2/16
2,904,792 A * 9/1959 Robert ..... 2/16
3,843,126 A * 10/1974 Bandy ..... 473/576
3,991,420 A * 11/1976 Savarino ..... 2/462
4,967,419 A * 11/1990 Elliott ..... 2/16
5,737,771 A * 4/1998 Aanonsen ..... 2/16
5,878,439 A * 3/1999 Waters, Jr. ..... 2/161.6
5,887,277 A * 3/1999 Lohman ..... 2/16
6,240,565 B1 * 6/2001 Spear ..... 2/158
6,298,488 B1 * 10/2001 Duncan et al. ..... 2/158
6,405,381 B1 * 6/2002 Bowman, Jr. ..... 2/170

* cited by examiner

*Primary Examiner*—Katherine Moran
(74) *Attorney, Agent, or Firm*—Blakely Sokoloff Taylor & Zafman LLP

(57) ABSTRACT

An apparatus that can function, in one aspect, as a cloth serving mitt. The apparatus includes a hollow tube having an inferior opening with dimensions for extending an arm there through. When an arm is extended through the tube, the serving mitt covers the arm from the fingers to a point above the elbow. With the fingers extended through the hollow tube, the fingers are able to assist in carrying items, such as dishes. There is also a thumb hole to aid in keeping the serving mitt in place during use while also allowing the thumb to assist in carrying the items. In one embodiment, the serving mitt includes at least one heat resistant pad attached to the tube so the user or the user's clothing will not be burned when carrying hot items on the user's arm.

9 Claims, 5 Drawing Sheets

SERVING MITT

BACKGROUND

Food servers commonly carry hot items and dishes when serving food. To serve food more efficiently, food servers often carry many hot items at one time. Carrying multiple items, such as warm or hot served plates of food, allows the server to serve multiple people in a single trip from a preparation area (e.g. kitchen) to a serving area (e.g. dining room). In transporting these numerous hot items and dishes, servers use trays, carts, and their own arms.

When using their arms to carry hot items, food servers may use towels, pot holders and their own clothing as a way of insulating themselves and their clothing from the heat of the items they are carrying. However, sometimes while transporting hot items on their arms, food servers misjudge the temperature of the dishes they are carrying and burn themselves, their clothing or both.

A situation where a food server is burned on the job is not only bad for the food server who is burned, but may also result in the food server missing days at work and have legal consequences for the food server's employer. Thus, there is a need for a device that allows food servers to carry hot dishes while insulating food servers and their clothing from being burned by these hot items and dishes.

DETAILED DESCRIPTION

Figure 1:
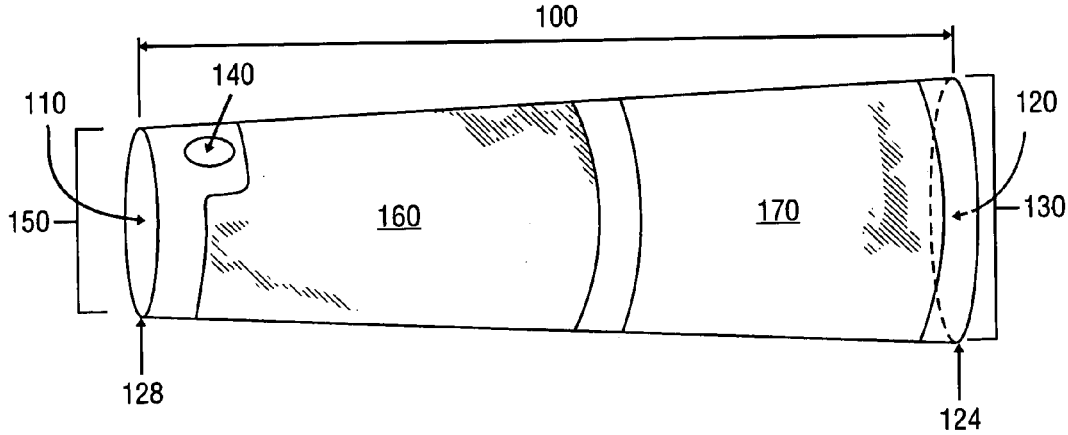
FIG. 1 is a top view of a first embodiment of an apparatus that may function as a serving mitt.
Figure 2:
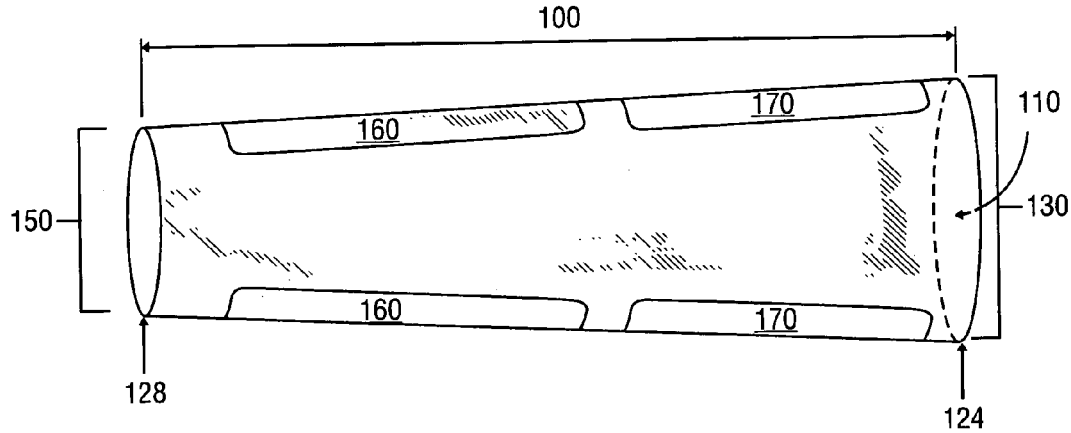
FIG. 2 is a bottom view of the apparatus of FIG. 1.
Figure 3:
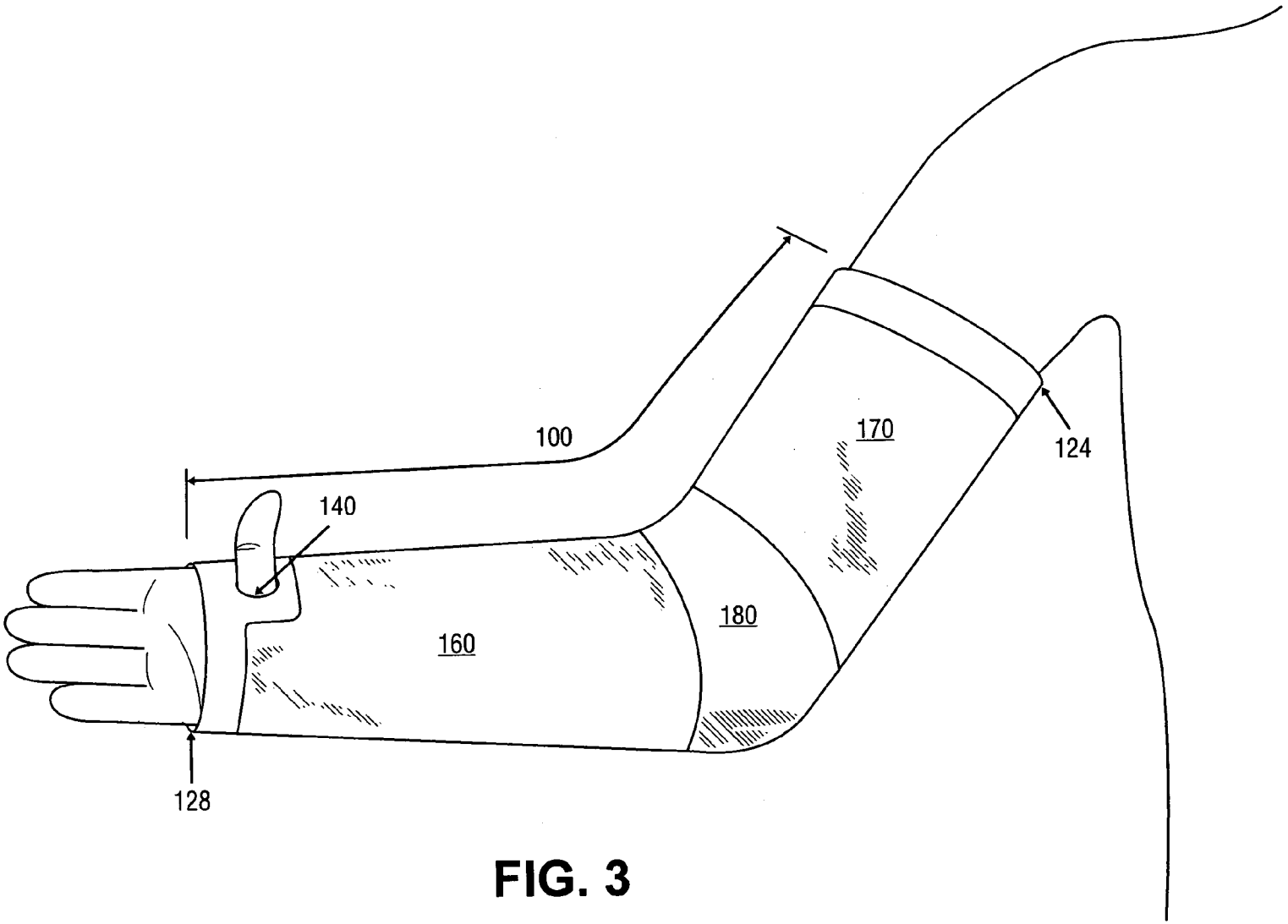
FIG. 3 is a top view of the apparatus of FIG. 1 when worn on a human arm.

FIGS. 1–4 show a first embodiment of an apparatus that may representably be used as a serving mitt. Referring to FIGS. 1–4, serving mitt 100 includes tube 110 that may be a length of cloth (e.g., 15 to 18 inches (38 to 46 centimeters)) with two edges connected to form a lumen 120 having first end 124 and second end 128. The length of cloth may be a material such as cotton or similar material that will resist burning when in contact with items heated to a temperature characteristic of serving dishes for a hot meal (e.g., on the order of 100 to 200 degrees Fahrenheit). Other suitable material for tube 110 may be a foam polymer or similar material that will not burn when in contact with items heated to a temperature characteristic of serving dishes for a hot meal (e.g., on the order of 100 to 200 degrees Fahrenheit). Alternatively, either the cloth or other material of tube 110 may be of a material that is resistant to the transfer of heat in this temperature range. Still alternatively, the cloth or other material may not be resistant to burning or the transfer of heat provided tube 110, in an embodiment where the apparatus is to be used as a serving mitt, includes a heat resistant pad connected thereto.

In the embodiment where tube 110 is formed of a length of cloth, the connection of material to form tube 110 is stitched together. Alternatively, in terms of cloth material for tube 110, other suitable techniques for connecting the material include, but are not limited to, glue, hook-and-loop mating fasteners (e.g., VELCRO™), pins, or zipper mating.

First end 124 forms first opening 130 and is of a size (e.g., diameter) for inserting both a human hand and a human arm (a top forearm surface, an opposed bottom forearm surface, an elbow, a top upper arm surface and an opposed bottom upper arm surface). The size of first opening 130 is large enough to accommodate at least a portion of the human arm above the elbow and is representably circular. An elastic band may be disposed in tube 110 at first end 124 (e.g., sewed into) to aid in keeping serving mitt 100 in place during use (e.g. keeping tube 110 snugly around bicep).

Second opening 140 is located one to two inches (2.5 to five centimeters) proximal to second end 128 (i.e., toward first end 124) and in an area suitable for placing a human thumb therethrough. The size (e.g., diameter) of second opening 140 is large enough that a human thumb may be extended therethrough, but small enough to aid in keeping serving mitt 100 in place while also allowing the thumb to be moveable. Second opening 140 is representably circular.

Second end 128 includes third opening 150 located one to two inches (2.5 to five centimeters) distal to second opening 140. Representatively, second opening 140 is located laterally from (e.g., perpendicular to) third opening 150. This configuration is consistent with the normal configuration of an adult hand where the thumb extends at an angle of approximately 45 degrees to 90 degrees from approximately the base of the palm. A representative distance between the base of the fingers on the palm and the base of the thumb is on the order of one to two inches (2.5 to five centimeters). Second end 128 is sized to accommodate a set of human fingers to be extended therethrough and allows the set of fingers the mobility to aid in gripping items being transported with serving mitt 100. An elastic band may be disposed in tube 110 at second end 128 (sewed into) to aid in keeping serving mitt 100 in place during use (e.g., keeping tube 110 snugly around the base of fingers). Thus, serving mitt 100 covers the length of a human arm from the fingers to a point above the elbow.

Heat resistant pad 160 is connected to tube 110 from a point slightly above third opening 150 to a point defining a lower edge of gap 180 and extends radially towards and including a portion, including, for example, the entire portion of the top forearm surface. Heat resistant pad 160 may cover slightly more than the entire bottom forearm surface in each respective direction.

In the illustrated embodiment, heat resistant pad 170 extends from a point defining the upper edge of gap 180 to a point slightly below first opening 130. Heat resistant pad 170 extends radial towards and including a portion, including, for example, the entire portion of the top upper arm surface. Heat resistant pad 170 may cover slightly more than the entire bottom upper arm surface in each respective direction.

Heat resistant pads 160 170 may be made out of a heat resistant material or a material that resists heat transfer. NOMEX® is a registered trademark of DuPont de Nemours of Wilmington, Del. and is an aramid fiber or fabric (copolymer of meta-0phenylenediamine and isophthaloyl chloride). NOMEX® is a suitable material as is a material like cotton that may be formed to a thickness that resists heat transfer at least for the period of time it takes to deliver hot dishes—one to two minutes. Heat resistant pads 160 170 are connected to tube 110, by means of, for example, stitching, glue, hook-and-loop mating fasteners (e.g., VELCRO™), pins or other connecting means. Heat resistant pads 160 170 having gap 180 between them allows a human elbow to bend while serving mitt 100 is in use.

Figure 4:
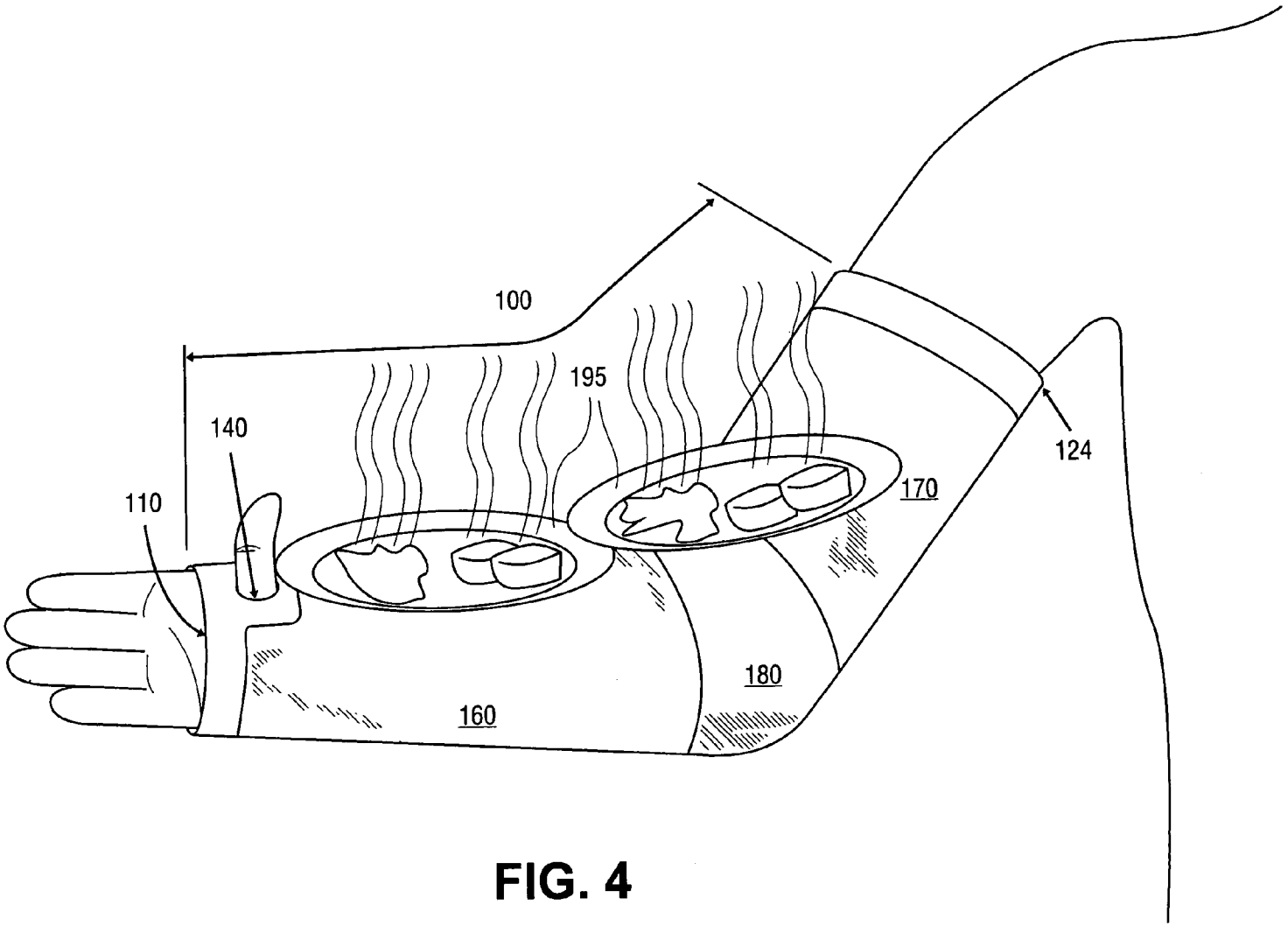
FIG. 4 is a top view of the apparatus of FIG. 1.

FIG. 4 shows serving mitt 100 in use. To use, a person can slip his/her arm through tube 110 placing their thumb in thumb hole 140 and fingers in third opening 150. In this manner, heat resistant pad 160 will be located on the top forearm surface and heat resistant pad 170 will be located on the top upper arm surface. Serving mitt 100 may be worn over the bare arm or over clothing. When worn, serving mitt 100 protects the user and the user's clothing from the heat emitted from items 195 (e.g., plates, pots, pans, bowls, cups, glasses, etc.) being carried on the user's arm. It is appreciated that servers often carry multiple hot items (e.g., plates) on their arm from a kitchen to a dining table.

Figure 5:
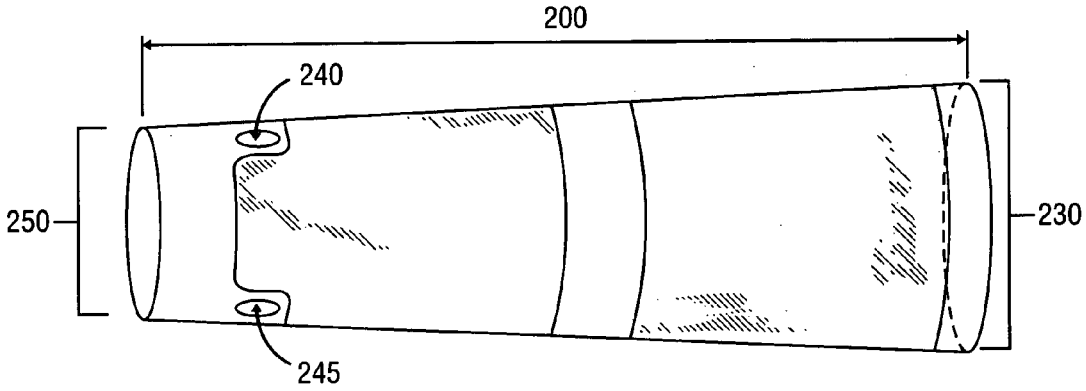
FIG. 5 is a top view of a second embodiment of an apparatus that may function as a serving mitt.

FIG. 5 shows another embodiment of serving mitt 200 having first opening 230, thumb hole 240, thumb hole 245 and second opening 250. Thumb holes 240 245 are located proximate third opening 250 in, with reference to the configuration of an adult human hand, an area suitable for extending a human thumb there through so that serving mitt 200 may be used on a human right hand and a human left hand, respectively.

Figure 6:
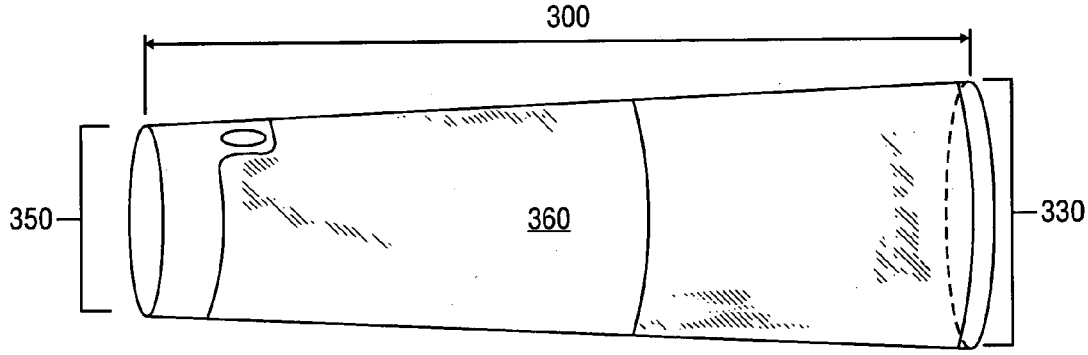
FIG. 6 is a top view of a third embodiment of an apparatus that may function as a serving mitt.

FIG. 6 shows another embodiment of serving mitt 300 wherein heat resistant pad 360 extends from a point slightly above second opening 350 to a point slightly below first opening 330 and also extends radial the entire exterior circumference of length of cloth. Thus, heat resistant pad 360 covers nearly the entire area of the length of cloth.

Figure 7:
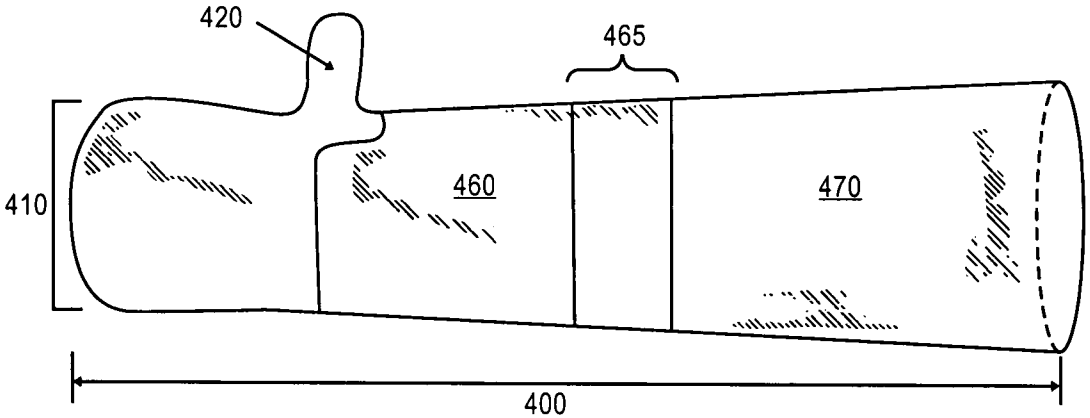
FIG. 7 is a top view of a fourth embodiment of an apparatus that may function as a serving mitt.

FIG. 7 shows another embodiment of serving mitt 400 wherein area 410 is formed in which a set of human fingers may be inserted into and area 420 for a human thumb to be inserted within. FIG. 7 shows heat resistant pad 460 and heat resistant pad 470 connected to serving mitt 400 and positioned along a length of serving mitt 400 to define gap 465 therebetween.

Figure 8:
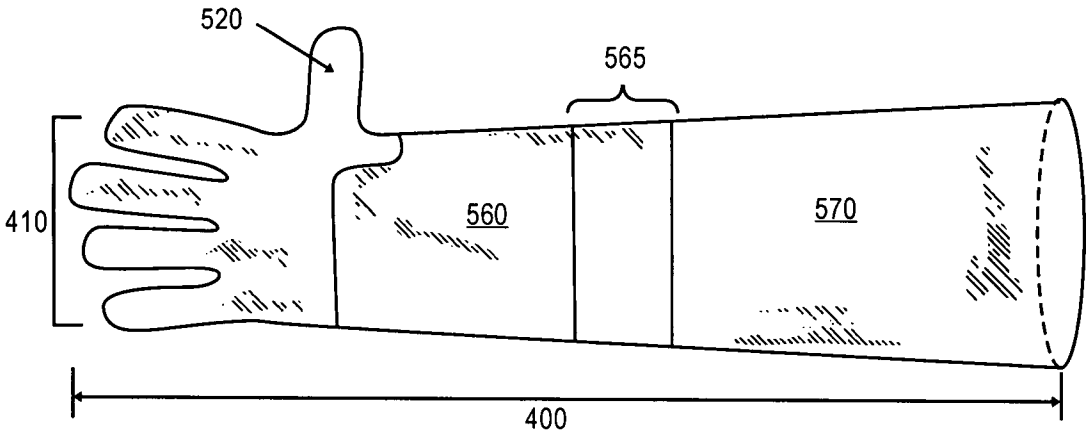
FIG. 8 is a top view of a fifth embodiment of an apparatus that may function as a serving mitt.

FIG. 8 shows another embodiment of serving mitt 500 wherein area 510, similar to a glove, is formed in which each individual finger of the user has its own respective space to be inserted within, including area 520 for a human thumb. FIG. 8 shows heat resistant pad 560 and heat resistant pad 570 connected to serving mitt 500 and positioned along a length of serving mitt 500 to define gap 565 therebetween.

What is claimed is:

1. An apparatus, comprising:

a length of cloth material comprising a hollow tube, wherein the tube extends a length of a human arm from a set of human fingers to a position above a human elbow, and the tube has a first end and a second end, the first end defining a first opening, wherein a human hand and arm may be inserted in the hollow tube, the second end defining a second opening and a different third opening, wherein the second opening has a dimension only large enough so that a thumb of a human may be inserted there through, the third opening postured distal to the second opening and having dimensions suitable for a plurality of fingers of a human hand to be inserted there through and protrude beyond the second end of the length of cloth material when an arm of a wearer is extended through the length of cloth material, at least one first heat resistant pad coupled to the length of cloth material and positioned such as to extend over a first portion of the length of cloth material wherein collectively the first pad and the first portion provide greater thermal protection than the first portion, at least one second heat resistant pad coupled to the length of cloth material and positioned such as to extend over a second different portion of the length of cloth material, wherein at least one first heat resistant pad and the at least one second heat resistant pad are positioned so as to define a gap, wherein when an arm of a wearer is extended through the length of cloth material, an elbow of the wearer may bend at the gap.

2. The apparatus of claim 1, further comprising:

at least two thumb holes, wherein the apparatus may be worn on one of a human right hand and a human left hand.

3. The apparatus of claim 1, wherein the at least one second pad has dimensions suitable to cover an adult human biceps.

4. The apparatus of claim 1, wherein the at least one firrst pad covers a human forearm.

5. The apparatus of claim 1, wherein the first pad is selected from the group consisting of an aramid fiber, cotton, and heat resistant cloth material.

6. An apparatus, comprising:

a length of cloth material comprising a hollow tube, wherein the tube extends a length of a human arm from a set of human fingers to a position above a human elbow, and the tube has a first end and a second end;

the first end defining a first opening, wherein a human hand and arm may be inserted in the hollow tube;

the second end defining a closed area for containing human fingers and a different closed area for containing a human thumb, wherein the closed area for the human thumb is postured distal to the area containing the human fingers;

at least one heat resistant pad; and at least one second heat resistant pad, wherein the first heat resistant pad and the second heat resistant pad are positioned so as to define a gap, wherein when an arm of a wearer is extended through the length of cloth material, an elbow of the wearer may bend at the gap.

7. The apparatus of claim 6, wherein the at least one first heat resistant pad has a dimension suitable to cover a portion of a human forearm.

8. The apparatus of claim 6, wherein the at least one second heat resistant pad has a dimension suitable to cover a human biceps.

9. The apparatus of claim 6, wherein the at least one heat resistant pad is selected from the group consisting of an aramid fiber, cotton, and heat resistant cloth material.

* * * * *